US009573376B2

(12) United States Patent
Kobayashi

(10) Patent No.: US 9,573,376 B2
(45) Date of Patent: Feb. 21, 2017

(54) WASTE LIQUID RECOVERY APPARATUS AND LIQUID EJECTING APPARATUS

(71) Applicant: SEIKO EPSON CORPORATION, Tokyo (JP)

(72) Inventor: Tsutomu Kobayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/939,466

(22) Filed: Nov. 12, 2015

(65) Prior Publication Data

US 2016/0059567 A1 Mar. 3, 2016

Related U.S. Application Data

(63) Continuation of application No. 14/196,024, filed on Mar. 4, 2014, now Pat. No. 9,216,579, which is a continuation of application No. 13/897,968, filed on May 20, 2013, now Pat. No. 8,708,471, which is a continuation of application No. 12/612,052, filed on Nov. 4, 2009, now Pat. No. 8,567,902.

(30) Foreign Application Priority Data

Nov. 7, 2008 (JP) ..... 2008-286712

(51) Int. Cl.

| | |
|---|---|
| ***B41J 2/165*** | (2006.01) |
| ***B41J 2/17*** | (2006.01) |
| ***B41J 2/185*** | (2006.01) |

(52) U.S. Cl.

CPC ..... *B41J 2/1721* (2013.01); *B41J 2/165* (2013.01); *B41J 2/185* (2013.01); *B41J 2002/1728* (2013.01)

(58) Field of Classification Search

None

See application file for complete search history.

(56) References Cited

U.S. PATENT DOCUMENTS

| | | | | |
|---|---|---|---|---|
| 5,329,306 | A | 7/1994 | Carlotta | |
| 6,866,363 | B2 * | 3/2005 | Oku | B41J 2/16508 347/31 |
| 2003/0067521 | A1 * | 4/2003 | Kaga | B41J 2/1721 347/86 |
| 2006/0007263 | A1 | 1/2006 | Nakano | |
| 2007/0273725 | A1 | 11/2007 | Furukawa et al. | |
| 2008/0158294 | A1 | 7/2008 | Katoh | |

FOREIGN PATENT DOCUMENTS

| | | |
|---|---|---|
| JP | 2006-218846 | 8/2006 |

* cited by examiner

*Primary Examiner* — Erica Lin

(74) *Attorney, Agent, or Firm* — Workman Nydegger

(57) ABSTRACT

A waste liquid recovery apparatus includes a container body; a liquid absorbing body which is accommodated in the container body and absorbs liquid discharged as a waste liquid; and a sealing member which seals the container body, wherein a first space into which liquid is discharged from a liquid ejecting head and a second space which links with the outside through a ventilation hole formed in the sealing member are formed in a space closed by the container body and the sealing body, and the first space and the second space are connected with each other at the ventilation hole side.

9 Claims, 5 Drawing Sheets

WASTE LIQUID RECOVERY APPARATUS AND LIQUID EJECTING APPARATUS

CROSS-REFERENCE TO RELATED APPLICATION

This application is a Continuation of U.S. patent application Ser. No. 14/196,024, filed May 4, 2014, which is a Continuation of U.S. patent application Ser. No. 13/897,968, filed May 20, 2013 and issued as U.S. Pat. No. 8,708,471 on Apr. 29, 2014, which is a Continuation of U.S. patent application Ser. No. 12/612,052, filed Nov. 4, 2009 and issued as U.S. Pat. No. 8,567,902 on Oct. 29, 2013, which claims priority to Japanese Patent Application No. 2008-286712, filed Nov. 7, 2008, which applications are expressly incorporated by reference herein.

BACKGROUND

1. Technical Field

The present invention relates to a waste liquid recovery apparatus and a liquid ejecting apparatus.

2. Related Art

A liquid ejecting apparatus is an apparatus which includes an ejecting head for ejecting a liquid and ejects various liquids onto a recording target member through the ejecting head. As a representative liquid ejecting apparatus, there is, for example, an ink jet type recording apparatus which includes an ink jet type recording head (hereinafter, referred to as simply a "recording head") and performs recording such that ink (a liquid) in a liquid state is ejected and landed as ink drops so as to form dots on a recording target member such as a recording paper from nozzles of the recording head.

An ink jet type recording apparatus performs a suction operation through which ink is forcibly discharged from nozzles as a maintenance process for maintaining or restoring the ejection characteristics of nozzles. Due to the suction operation, ink discharged from nozzles is recovered in a waste ink tank (a waste liquid recovery apparatus) (for example, Japanese Patent Application Laid-Open No. 2006-218846).

However, in the waste ink tank according to the related art, there is no consideration of an ink leak occurring when a holding posture of the tank is changed. Therefore, when the waste ink tank is inclined, there is a possibility that ink stored in the tank will leak.

SUMMARY

An advantage of some aspects of the invention is that it provides a waste liquid recovery apparatus and a liquid ejecting apparatus in which inhibits ink leaks even when the holding posture is changed.

According to an aspect of the invention, there is provided a waste liquid recovery apparatus including: a container body; a liquid absorbing body which is accommodated in the container body and absorbs liquid discharged as a waste liquid; and a sealing member which seals the container body, wherein a first space into which the liquid is discharged from a liquid ejecting head and a second space which is linked with the outside through a ventilation hole formed in the sealing member are formed in a space closed off by the container body and the sealing body, and the first space and the second space are connected with each other at the ventilation hole side.

According to the waste liquid recovery apparatus of the invention, for example, even when the waste liquid recovery apparatus in which the sealing member side faces upward is inclined, it is possible to prevent liquid in the first space from leaking from the ventilation hole. Further, since the first space is connected with the ventilation hole through the second space, it is possible to prevent liquid in the first space from being volatilized and solidified, and liquid can be effectively absorbed by the liquid absorbing body.

The waste liquid recovery apparatus may further includes a discharge hole through which liquid is discharged into the first space, wherein at least one of the discharge hole and the ventilation hole may be disposed substantially at a central part of the container body in a plan view.

According to this configuration, the ventilation hole is disposed substantially at the central part, and thus when the container body is inclined, a liquid leak from the ventilation hole can be inhibited. Further, the discharge hole is disposed substantially at the central part of the container body, and thus liquid is absorbed substantially from the central part of the liquid absorbing body, and the liquid absorbing body can be efficiently used.

In the waste liquid recovery apparatus, a tubular extension member which extends toward the second space side may be disposed in the ventilation hole.

According to this configuration, for example, even when the waste liquid recovery apparatus is transported in a state in which it is flipped or rotated vertically, the extension member blocks liquid, whereby a liquid leak from the ventilation hole is inhibited.

In the waste liquid recovery apparatus, a groove portion which is linked with the second space may be formed in an upper part of the liquid absorbing body.

According to this configuration, air discharged from the liquid absorbing body which has absorbed liquid is guided into the second space through the groove portion. Therefore, a liquid can be effectively absorbed by the liquid absorbing body.

In the waste liquid recovery apparatus, the first space and the second space may be partitioned through a partition member and formed adjacent to each other.

According to this configuration, for example, one space is separated by the partition member so as to form the first space and the second space. When either the first space or the second space is disposed at a central part of the inside of the waste liquid recovery apparatus, the first space and the second space are disposed substantially at the central part of the inside of the waste liquid recovery apparatus. When the second space is disposed at the central part, a liquid leak from the ventilation hole at the time of posture change can be inhibited. When the first space is disposed at the central part, liquid can be effectively absorbed by the whole liquid absorbing body.

In the waste liquid recovery apparatus, the partition member may be configured by the liquid absorbing body.

According to this configuration, since the partition member is configured by the liquid absorbing body, the number of components can be reduced, thereby simplifying an apparatus configuration.

According to another aspect of the invention, there is provided a liquid ejecting apparatus including: the waste liquid recovery apparatus.

According to the liquid ejecting apparatus of the invention, for example, even when the liquid ejecting apparatus is transported in an inclined state, leaking of waste liquid can be inhibited due to the waste liquid recovery apparatus described above. Further, since volatilization of a waste liquid is inhibited due to the waste liquid recovery apparatus, liquid absorbability of the liquid absorbing body is maintained for a long period of time, and the maintenance cycle can be increased.

In the liquid ejecting apparatus, the waste liquid recovery apparatus may be detachably mounted.

According to this configuration, since the waste liquid apparatus is easily attached or detached as a unit, the liquid absorbing body which has absorbed liquid can be easily replaced, and excellent maintainability can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings. In respective drawings used in the below description, a reduction scale of respective members is appropriately changed to enlarge respective members to a recognizable size.

First Embodiment

Figure 1:
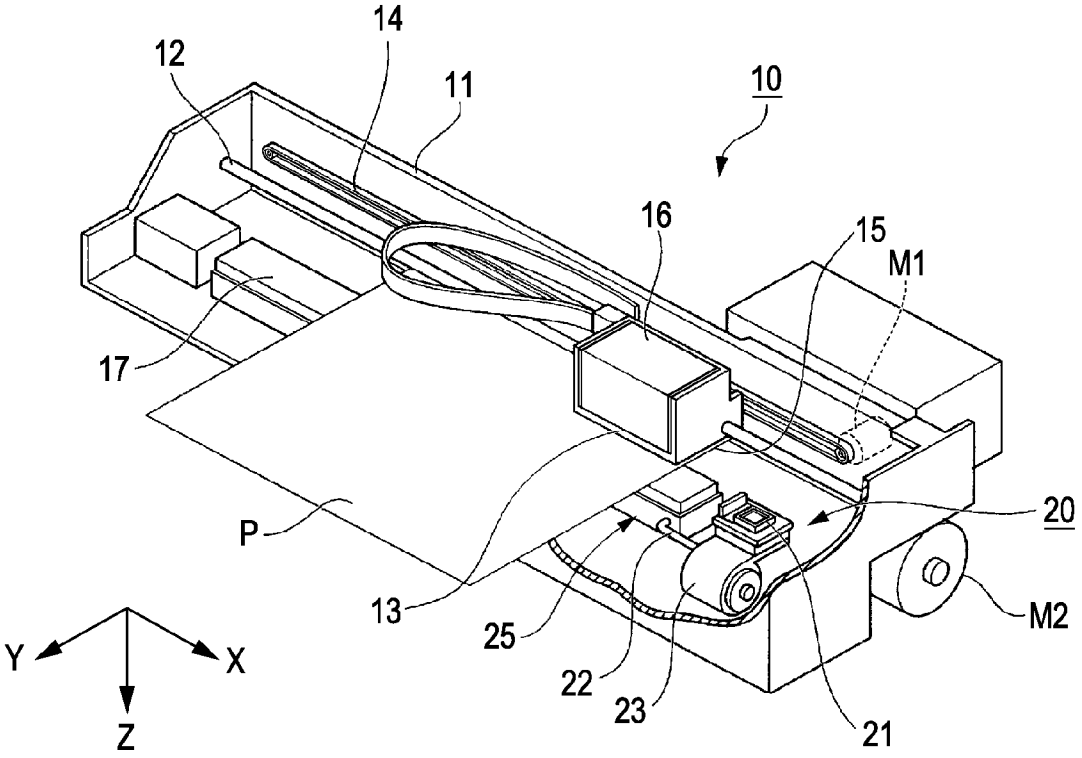
FIG. 1 is a perspective view illustrating an ink jet type printer.
Figure 2:
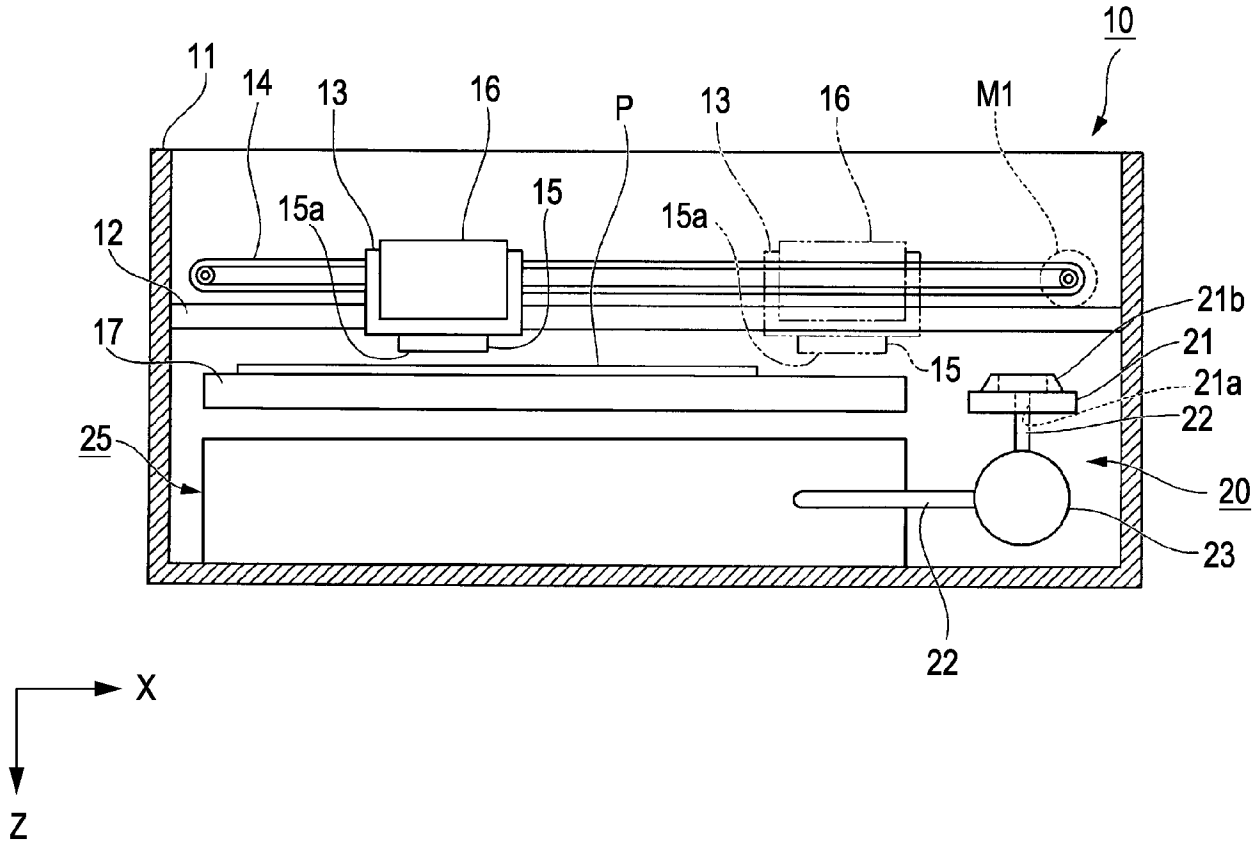
FIG. 2 is a schematic main part front-cross-sectional view illustrating an ink jet type printer.

FIGS. 1 and 2 are a perspective view and a main part front cross-sectional view illustrating an ink jet type printer (hereinafter, referred to as simply "printer") as a liquid ejecting apparatus. As illustrated in FIG. 1, a printer 10 includes a body case 11. The body case 11 covers the whole printer 10 and is configured in the form of a box.

A rod-shaped guide member 12 is installed in a longitudinal direction (an X-axis direction in FIG. 1) in the body case 11 as illustrated in FIG. 1. A carriage 13 is inserted into and supported on the guide member 12 so as to move in a left-right direction X. The carriage 13 is connected to a carriage motor M1 through a timing belt 14 and is operated by the carriage motor M1.

When the carriage motor M1 is rotationally driven, driving force is transferred to the carriage 13 through the timing belt 14. The carriage 13 which has received driving force reciprocates in an X-axis direction along the guide member 12.

On a bottom of the carriage 13, as illustrated in FIG. 2, a recording head 15 used as a liquid ejecting head is mounted. On a bottom of the recording head 15, as illustrated in FIG. 2, a nozzle mounting surface 15*a* is disposed. A plurality of liquid ejecting nozzles (hereinafter, referred to as simply "nozzles") for ejecting liquid, which is not illustrated in the drawings, is disposed on the nozzle mounting surface 15*a*.

At the upper side of the recording head 15 of the carriage 13, as illustrated in FIG. 1, an ink cartridge 16 used as a liquid storage means is detachably mounted. Ink as a liquid is stored in the ink cartridge 16 so as to be able to be supplied to the recording head 15. In the present embodiment, the ink is pigment ink and the ink contains an aqueous solvent (a solvent component) which is a volatile component and pigment (a dispersive component) which is a non-volatile component dispersed by a dispersive agent. Ink containing a different component may be used, and ink is not limited to certain ink.

A platen 17 is disposed below the carriage 13 as illustrated in FIG. 1. The platen 17 is a support base which supports recording paper P as a target, and a paper feeding mechanism which is not illustrated in the drawings is installed on a top surface thereof. The paper feeding mechanism is configured to feed recording paper P in a direction (a Y-axis direction in FIG. 1) crossing the X-axis direction when a paper feeding motor M2 is driven.

When an image signal generated based on image data is input, the printer 10 drives the paper feeding motor M2 so as to feed recording paper P in the +Y direction, and rotationally drives the carriage motor M1 so as to reciprocate the carriage 13 in the X-axis direction. At the same time, the printer 10 ejects ink drops from the reciprocating recording head 15 to perform printing on recording paper P.

As illustrated in FIG. 1, a non-printing area in which printing is not performed is prepared at the right side within the body case 11. A cleaning mechanism 20 is disposed in the non-printing area. The cleaning mechanism 20 includes a cap 21 used as a sealing means, a discharge tube 22, a suction pump 23, and a recovery tank (a waste liquid recovery apparatus) 25 used as a recovery means which recovers ink discharged by the suction pump as illustrated in FIG. 1. The recovery tank 25 is mounted so as to be easily attached to or detached from the body case 11.

The cap 21 is formed in the form of a box whose top surface is opened as illustrated in FIG. 1. The cap 21 is supported so as to reciprocate in the direction (a Z-axis direction in FIG. 2), which crosses the left-right direction X and the front-rear direction Y, by a lifting mechanism, which is not illustrated in the drawings, disposed in the non-printing area. On a bottom of the cap 21, a suction hole 21*a* is formed to be penetrated along the Z-axis direction. On an upper edge of the cap 21, an outer frame 21*b* of a square frame shape made from a flexible member is disposed.

When the recording head 15 moves to the non-printing area and the cap 21 moves up, the outer frame 21*b* of the cap 21 comes in contact with the recording head 15 so as to seal the nozzle mounting surface 15*a*. Therefore, a space which seals the nozzle mounting surface 15*a*, that is, an inner-cap space is formed in the cap 21.

The recovery tank 25 is disposed below the platen 17 disposed on a bottom of the body case 11. The recovery tank 25 is a container formed in a rectangular parallelepiped shape as illustrated FIGS. 1 and 2, and the inside of the container is linked with the inner-cap space through the discharge tube 22 connected with the suction hole 21*a*. The suction pump 23 is disposed in the middle of the discharge tube 22. The suction pump 23 is a pump which is operated by a pump motor which is not illustrated in the drawings and forms negative pressure opposing suction capability thereof in the inner-cap space.

When the suction pump 23 operates to form negative pressure in the inner-cap space, ink of increased viscosity in the recording head 15 is ejected toward the inner-cap space from the nozzles, and cleaning of the recording head 15 is performed. At this time, ink ejected into the inner-cap space is suctioned by the suction pump 23 and becomes ink (discharge ink) including gas (a bubble) within the inner-cap space. The discharge ink is discharged to the downstream of the discharge tube 22, that is, into the recovery tank 25.

Figure 3:
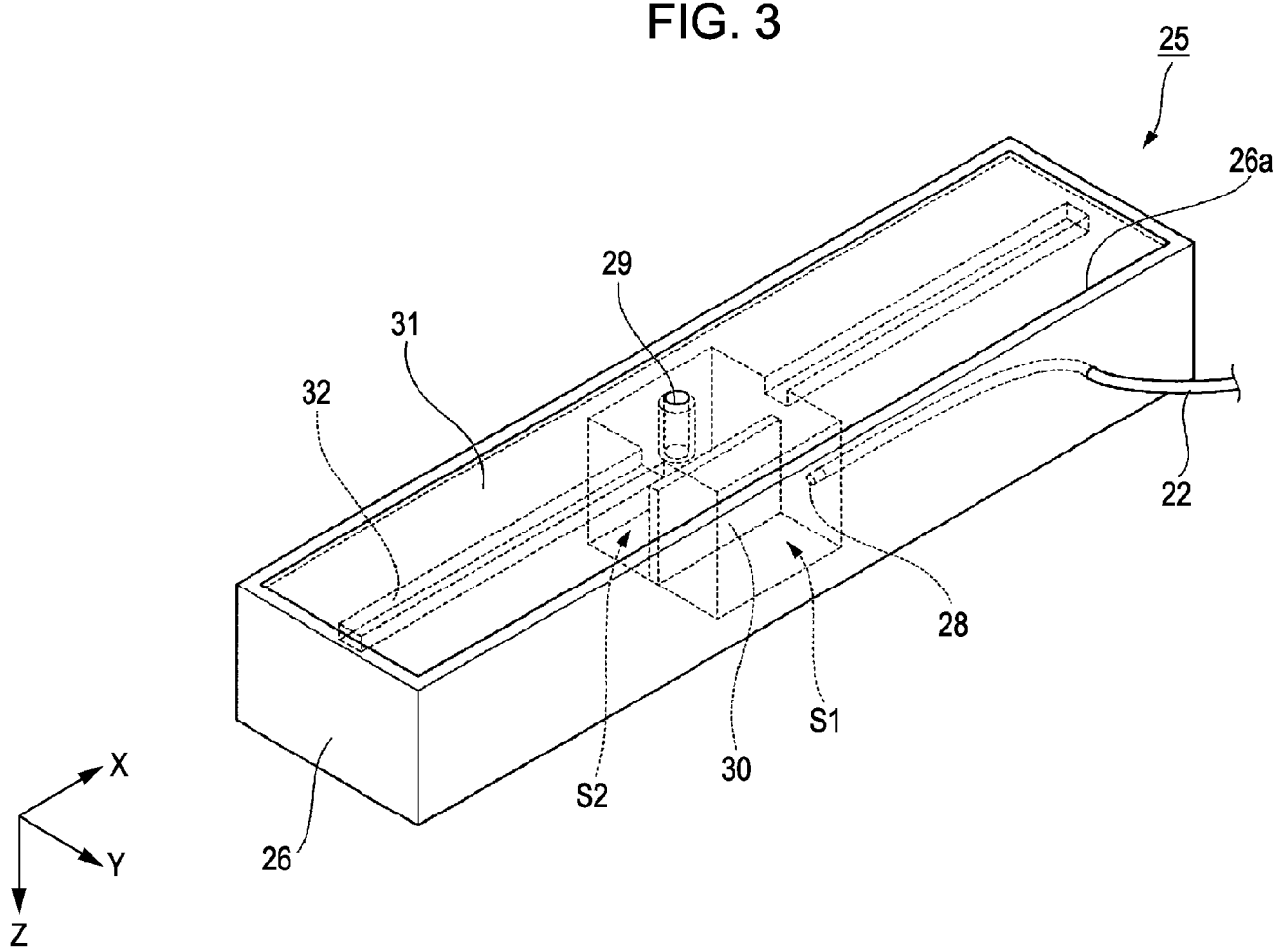
FIG. 3 is a perspective view illustrating a configuration of a recovery tank.
Figure 4A:
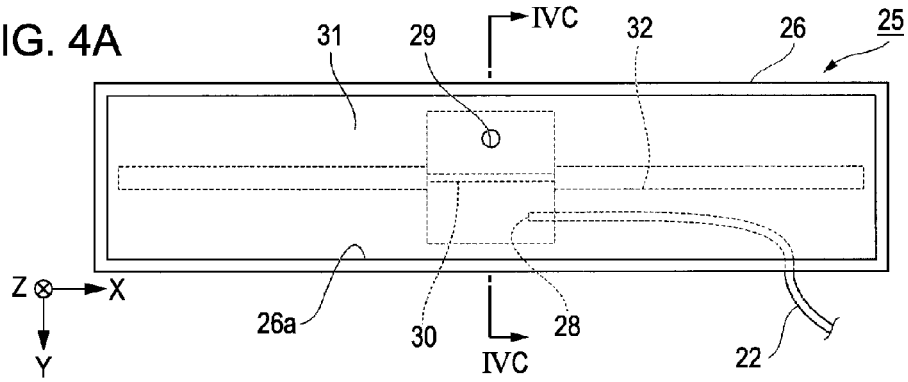
FIGS. 4A to 4D are plan views and cross-sectional views of a recovery tank.
Figure 4B:
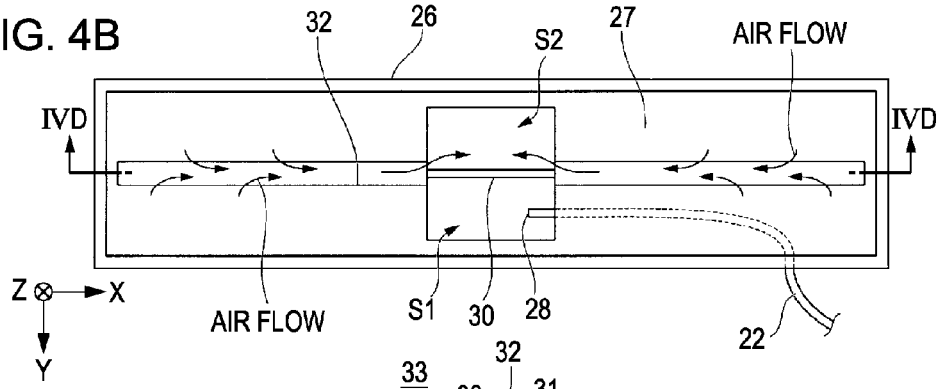
Figure 4C:
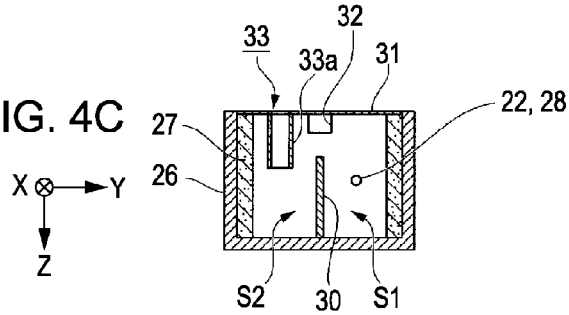
Figure 4D:
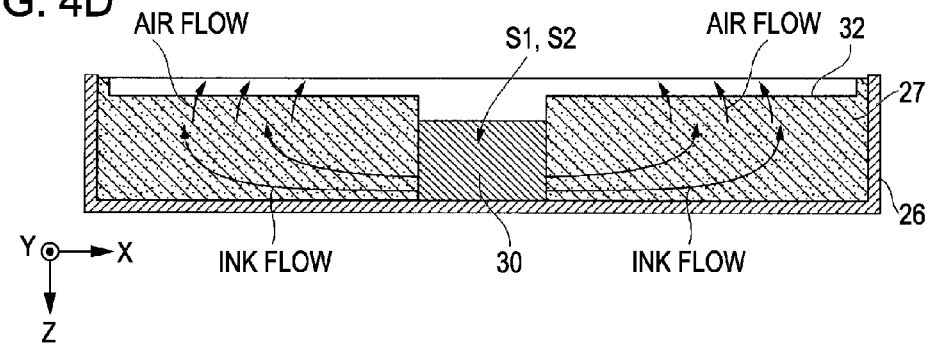

FIG. 3 is a perspective view illustrating a configuration of the recovery tank 25, and FIGS. 4A to 4D are plan views and cross-sectional views of the recovery tank 25. FIG. 4A is a plan view of the recovery tank 25, FIG. 4B is a plan view illustrating an internal configuration of the recovery tank 25, FIG. 4C is a cross-sectional view taken along line IVA-IVA of FIG. 4A, and FIG. 4D is a cross-sectional view taken along line IVB-IVB of FIG. 4B.

The recovery tank 25 includes a storage container 26 used as a container body as illustrated in FIG. 3. The storage container 26 is made of, for example, plastic and includes a bottomed member having an opening 26*a* at its upper side. An ink absorbing body 27 used as a liquid absorbing body is accommodated in the storage container 26. The upper part of the opening 26*a* is sealed with a sealing film (a sealing member) 31. The ink absorbing body 27 includes a porous member. The ink absorbing body 27 may include a single porous member or sheet-like porous members which are stacked.

In a space of the recovery tank 25 which is closed by the sealing film 31 and the storage container 26, an ink discharge space (a first space) S1 into which ink is discharged from the recording head 15 through the discharge tube 22 and an air discharge space (a second space) S2 which is linked with the outside through a ventilation hole 29 formed at the upper side are formed. The ink discharge space S1 and the air discharge space S2 are separated by a partition plate (a partition member) 30 which extends upward (in a −Z direction in FIG. 3) from the bottom of the storage container 26 as illustrated in FIGS. 4C and 4D. That is, the ink discharge space S1 and the air discharge space S2 are disposed adjacent to each other (see FIGS. 4A to 4D). The partition plate 30 is made of, for example, plastic. The partition plate 30 may be integrated with the storage container 26 or may be configured by a member different from the storage container 26.

The ink discharge space S1 and the air discharge space S2 are connected to each other at the upper side (the ventilation hole 29 side) as illustrated FIGS. 3, 4C, and 4D. As described above, in the present embodiment, the ink discharge space S1 and the air discharge space S2 are formed through a space closed by the ink absorbing body 27, the partition plate 30, and the sealing film 31.

The ink discharge space S1 and the air discharge space S2 are disposed substantially at a central part of the storage container 26 in a plan view (in a state viewed in the minus Z direction in FIG. 3) adjacent to each other. The ventilation hole 29 is formed at a location overlapping the air discharge space S2 when the sealing film 31 is seen from above. The discharge tube 22 is disposed so as to protrude into the ink discharge space S1, and a discharge hole 28 is disposed substantially at a central part of the ink discharge space S1 in a plan view. That is, in the present embodiment, the ventilation hole 29 and the discharge hole 28 are disposed substantially at a central part of the storage container 26.

Further, a groove portion 32, which extends along a longitudinal direction (an X direction in FIGS. 3 and 4) of the ink absorbing body 27 and is linked with the air discharge space S2, is formed in an upper part of the ink absorbing body 27. A tubular extension member 33, which extends toward the inside of the air discharge space S2, is disposed in the ventilation hole 29. The tubular extension member 33 is attached to the sealing film 31. Therefore, air in the air discharge space S2 is discharged to the outside through a tubular extension part 33*a* of the extension member 33.

Next, operation of the recovery tank 25 will be described.

In the printer 10, when the suction pump 23 operates and cleaning starts, ink discharged from the suction pump 23 is introduced (discharged) into the ink discharge space S1 through the discharge tube 22. At this time, ink introduced into the ink discharge space S1 is absorbed into the ink absorbing body 27 which constitutes a part of a side wall. At this time, since the upper side of the ink discharge space S1 is sealed with the sealing film 31, volatilization of a solvent component is inhibited, and solidification of a dispersive component is delayed, whereby ink introduced into the ink discharge space S1 is effectively absorbed by the ink absorbing body 27 as described above.

In the present embodiment, the ink discharge space S1 and the discharge hole 28 are disposed substantially at a central part of the storage container 26 as described above. Therefore, ink starts to be absorbed substantially from a central part of the ink absorbing body 27, and ink is spread over the whole ink absorbing body 27 and stored due to capillary force.

When ink is absorbed into the ink absorbing body 27, air present in small gaps of the ink absorbing body 27 is discharged upward (see FIG. 4D). Air discharged as described above is guided into the air discharge space S2 through the groove portion 32 formed in the upper part of the ink absorbing body 27 and is discharged to the outside through the ventilation hole 29. Since air present in small gaps within the ink absorbing body 27 is discharged upward, ink can be effectively spread over the whole ink absorbing body 27 due to capillary force as described above.

According to the present embodiment, use efficiency of the ink absorbing body 27 can be improved. Therefore, ink absorbability of the ink absorbing body 27 is maintained for a long period of time, and the maintenance cycle of the printer 10 can be increased.

Further, since the recovery tank 25 detachably mounted to the body case 11 is easily attached or detached as a unit, the ink absorbing body 27 which has absorbed ink can be easily replaced, and excellent maintainability can be obtained.

However, the installation place of the printer 10 may change due to convenience of the user. In this case, there is a possibility that the printer 10 will be transported in an inclined state. In this case, the recovery tank 25 installed in the printer 10 is also inclined.

According to the printer 10 of the present embodiment, even when the recovery tank 25 is inclined, since the ventilation hole 29 is formed in the air discharge space S2 which is connected with the ink discharge space S1 only through the upper part, ink leaks within the ink discharge space S1 from the ventilation hole 29 can be inhibited. Further, since the ventilation hole 29 is disposed substantially at the central part of the storage container 26, it is possible to prevent the liquid level of ink from moving when the recovery tank 25 is inclined, whereby ink leaks from the ventilation hole 29 can be inhibited.

When the printer is transported, there is a possibility in the worst possible case that the printer 10 (the recovery tank 25) will be flipped or rotated vertically during transportation. In this case, the possibility increases that ink will leak from the ventilation hole 29.

Figure 5:
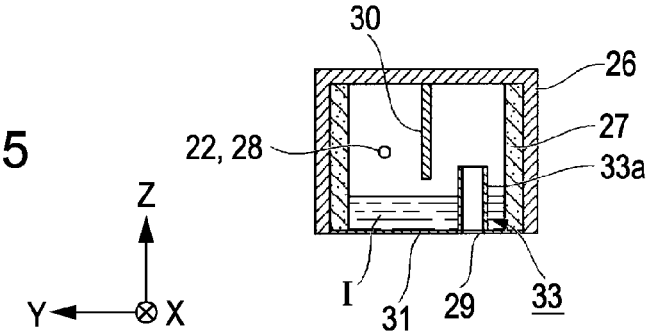
FIG. 5 is a view for explaining the operation of a recovery tank.

However, according to the present embodiment, since the extension member 33 which extends toward the air discharge space S2 side is disposed in the ventilation hole 29, even when the recovery tank 25 is vertically flipped, the extension part 33*a* blocks waste ink I as illustrated in FIG. 5. Accordingly, leaking of waste ink I from the ventilation hole 29 can be inhibited.

Second Embodiment

Next, a printer 10 according to a second embodiment will be described with reference to the accompanying drawings. In the drawings, the same reference numerals as in the first embodiment denote the same parts as in the first embodiment, and a description on them will be omitted. The second embodiment is different in configuration of a recovery tank from the first embodiment.

Figure 6:
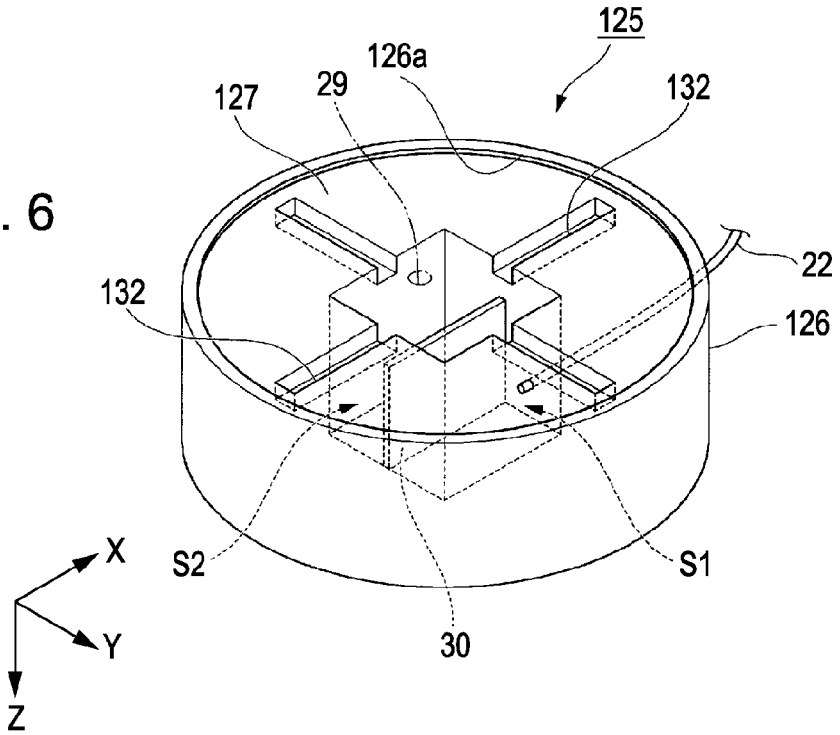
FIG. 6 is a perspective configuration view of a recovery tank according to a second embodiment.

FIG. 6 is a perspective configuration view of a recovery tank 125 according to the present embodiment. In FIG. 6, the sealing film formed on a top surface, the ventilation hole formed therein, and the extension member formed in the ventilation hole are not illustrated in the drawing. As illustrated in FIG. 6, the recovery tank 125 includes a cylindrical storage container 126 used as a container body. The storage container 126 includes a bottomed member which has an opening 126*a* at its upper side. An ink absorbing body 127 as a liquid absorbing body is accommodated in the storage container 126. An upper part of the opening 126*a* is sealed with the sealing film which is not illustrated in the drawing.

In a space of the recovery tank 125 which is closed by the sealing film which is not illustrated in the drawing and the storage container 126, an ink discharge space (a first space) S1 into which ink is discharged from the recording head 15 through the discharge tube 22 and an air discharge space (a second space) S2 which is linked with the outside through the ventilation hole 29 formed at the upper side are formed. The ink discharge space S1 and the air discharge space S2 are separated by the partition plate 30 which extends upward (in a minus Z direction in FIG. 6) from the bottom of the storage container 126 as illustrated in FIG. 6.

In the present embodiment, the ink discharge space S1 and the air discharge space S2 are disposed substantially at the central part of the storage container 126 in a plan view (in a state viewed in the minus Z direction in FIG. 6) adjacent to each other.

A groove portion 132 which is linked with the air discharge space S2 is formed in an upper part of the ink absorbing body 127. In the present embodiment, since the storage container 126 has a circular plane shape as described above, the groove portions 132 are radially formed in four directions from the center of the ink absorbing body 127. The number of directions in which the groove portions 132 are formed is not limited to four, and the groove portions 132 may be radially formed in five or more directions.

According to this configuration, when ink is absorbed into the ink absorbing body 127 and air present in small gaps of the ink absorbing body 127 is discharged upward, discharged air is guided into the air discharge space S2 through the groove portions 132 radially formed in the upper part of the ink absorbing body 127 and is discharged to the outside through the ventilation hole 29. Even in the case of using the recovery tank 125 including the cylindrical bottomed member, since air is discharged upward from the inside of the ink absorbing body 127, ink can be effectively spread over the whole ink absorbing body 127 due to capillary force.

Hereinbefore, the embodiments of the invention have bee described with reference to the accompanying drawings, but the invention is not limited to the embodiments described above, and the embodiments may be combined. It will be understood to those skilled in the art that various modification or variations can be made within the scope of the invention as defined in the claims and included within the scope of the invention.

Figure 7:
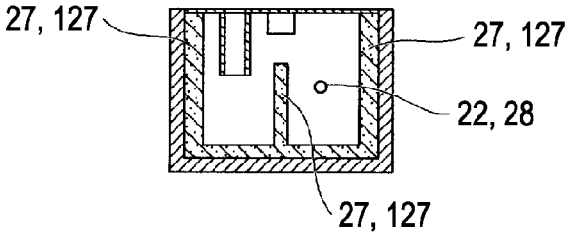
FIG. 7 is a view illustrating a configuration of a recovery tank according to a modification embodiment.

For example, in the first and second embodiments, the ink discharge space S1 and the air discharge space S2 are configured to be separated from each other by the partition plate 30, but the ink discharge space S1 and the air discharge space S2 may be separated from each other by the ink absorbing bodies 27, 127 as illustrated in FIG. 7. According to this configuration, since the partition member is configured by the ink absorbing bodies 27, 127, the number of components of the recovery tank can be reduced, and the configuration can be simplified.

What is claimed is:

1. A waste liquid recovery apparatus, comprising:

a container body which includes a bottom and side walls extending from the bottom;

a liquid absorbing body which is accommodated in the container body and absorbs liquid discharged as a waste liquid;

a first area into which the liquid is discharged from a liquid ejecting head, the first area being located in the container body;

a second area which communicates with the outside via an opening portion, the second area being located in the container; and a partition member which is provided between the first area and the second area;

wherein the liquid is discharged into the first area via one of the side walls which extends in a direction along the partition member, and the liquid discharged into the first area reaches the second area via a third area which is arranged between at least one end of the partition member and at least one of the side walls.

2. The waste liquid recovery apparatus according to claim 1, wherein the partition member extends in a direction which intersects a direction toward the second area from the first area.

3. The waste liquid recovery apparatus according to claim 1, wherein the partition member extends from the bottom of the container body.

4. The waste liquid recovery apparatus according to claim 1, wherein the liquid absorbing body is disposed in the third area.

5. The waste liquid recovery apparatus according to claim 1, wherein the container body includes a space, wherein the space is provided above the third area, the space being provided in a position higher than a top of the partition member.

6. The waste liquid recovery apparatus according to claim 1, wherein the opening portion is provided at a position higher than a position where the liquid is discharged into the first area.

7. The waste liquid recovery apparatus according to claim 1, wherein the opening portion is not provided above the first area.

8. A liquid ejecting apparatus, comprising:

a liquid ejecting head which ejects liquid; and a waste liquid recovery apparatus, the waste liquid recovery apparatus including:

a container body which includes a bottom and side walls extending from the bottom;

a liquid absorbing body which is accommodated in the container body and absorbs liquid discharged as a waste liquid;

a first area into which the liquid is discharged from a liquid ejecting head, the first area being located in the container body;

a second area which communicates with the outside via an opening portion, the second area being located in the container body; and a partition member which is provided between the first area and the second area;

wherein the liquid is discharged into the first area via one of the side walls which extends in a direction along the partition member, and the liquid discharged into the first area reaches the second area via a third area which is arranged between at least one end of the partition member and at least one of the side walls.

9. The liquid ejecting apparatus according to claim 8, wherein the third area is arranged to an outside of the first area and the second area in a width direction of a medium which is transported.

* * * * *